US011953209B2

(12) United States Patent
Wrehde et al.

(10) Patent No.: US 11,953,209 B2
(45) Date of Patent: Apr. 9, 2024

(54) COOKING APPLIANCE DEVICE WITH COOKING CHAMBERS AND INDIVIDUAL LIGHTING OF THE CHAMBERS ON THE BASIS OF A SETTING, AND METHOD

(71) Applicant: BSH Hausgeräte GmbH, Munich (DE)

(72) Inventors: Edith Wrehde, Nußdorf (DE); Joschka Bär, Surberg-Hufschlag (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 18/027,964

(22) PCT Filed: Nov. 17, 2021

(86) PCT No.: PCT/EP2021/081995
§ 371 (c)(1),
(2) Date: Mar. 23, 2023

(87) PCT Pub. No.: WO2022/106472
PCT Pub. Date: May 27, 2022

(65) Prior Publication Data

US 2023/0366559 A1 Nov. 16, 2023

(30) Foreign Application Priority Data

Nov. 20, 2020 (DE) ..... 102020214630.6
Nov. 12, 2021 (DE) ..... 102021212762.2

(51) Int. Cl.
*F24C 15/00* (2006.01)
*F24C 7/04* (2021.01)
(Continued)

(52) U.S. Cl.
CPC ..... *F24C 15/008* (2013.01); *F24C 7/046* (2013.01); *F24C 7/062* (2013.01); *F24C 7/067* (2013.01);
(Continued)

(58) Field of Classification Search
CPC ..... F24C 15/008; F24C 7/085; F21V 33/0044
See application file for complete search history.

(56) References Cited

U.S. PATENT DOCUMENTS

2007/0246451 A1 10/2007 Willett
2017/0273314 A1 9/2017 Bigott
2018/0192482 A1* 7/2018 Kim ..... F24C 15/2007

FOREIGN PATENT DOCUMENTS

CN 104814669 A * 8/2015 ..... F21V 33/00
DE 102014004836 A1 10/2015
EP 3771291 A1 * 1/2021 ..... F24C 15/008

OTHER PUBLICATIONS

National Search Report DE 10 2021 212 762.2 dated Aug. 8, 2022.
International Search Report PCT/EP2021/081995 dated Feb. 16, 2022.

* cited by examiner

*Primary Examiner* — Robert J May
(74) *Attorney, Agent, or Firm* — Michael E. Tschupp; Andre Pallapies; Brandon G. Braun

(57) ABSTRACT

A cooking appliance apparatus includes a first cooking compartment, a second cooking compartment that is different from the first cooking compartment, an operating apparatus designed to set operating conditions for both the first cooking compartment and the second cooking compartment, and an illumination apparatus designed to illuminate the first and second cooking compartments in such a way that depending on for which one of the first and second cooking compartments the operating apparatus currently sets the operating conditions, only the one of the first and second cooking compartments is illuminated by the illumination apparatus with a specific identification illumination scenario.

19 Claims, 1 Drawing Sheet

(51) Int. Cl.

| | |
|---|---|
| ***F24C 7/06*** | (2006.01) |
| ***F24C 7/08*** | (2006.01) |
| ***F24C 15/16*** | (2006.01) |
| ***F24C 15/32*** | (2006.01) |

(52) U.S. Cl.
CPC ..... *F24C 7/085* (2013.01); *F24C 15/007* (2013.01); *F24C 15/16* (2013.01); *F24C 15/166* (2013.01); *F24C 15/322* (2013.01); *F24C 15/325* (2013.01)

COOKING APPLIANCE DEVICE WITH COOKING CHAMBERS AND INDIVIDUAL LIGHTING OF THE CHAMBERS ON THE BASIS OF A SETTING, AND METHOD

CROSS-REFERENCES TO RELATED APPLICATIONS

This application is the U.S. National Stage of International Application No. PCT/EP2021/081995, filed Nov. 17, 2021, which designated the United States and has been published as International Publication No. WO 2022/106472 A1 and which claims the priorities of German Patent Applications, Serial Nos. 10 2020 214 630.6, filed Nov. 20, 2020 and 10 2021 212 762.2, filed Nov. 12, 2021, pursuant to 35 U.S.C. 119(a)-(d).

The contents of International Application No. PCT/EP2021/081995 and German Patent Applications, Serial Nos. 10 2020 214 630.6 and 10 2021 212 762.2 are incorporated herein by reference in their entireties as if fully set forth herein.

BACKGROUND OF THE INVENTION

One aspect of the invention relates to a cooking appliance apparatus having a first cooking compartment and having at least one second cooking compartment that is different therefrom. The cooking compartments are each intended for the introduction of foodstuffs, in particular for the preparation of foodstuffs in the cooking compartment. Furthermore, the cooking appliance apparatus has at least one illumination apparatus for illuminating the cooking compartments. Furthermore, the cooking appliance apparatus has an operating apparatus for setting operating conditions of the cooking appliance apparatus. A further aspect of the invention relates to a method for operating a cooking appliance apparatus.

Cooking appliances are known in a variety of embodiments. They can be formed as an oven or a microwave cooking appliance or a steam cooking appliance apparatus. Such appliances also differ from a cooktop, for example, to the extent that they have a housing in which at least one cooking compartment is formed and said cooking compartment is delimited by walls.

In order to be able to observe the at least one cooking compartment in an improved manner, for example, when the door of the cooking appliance, which has a viewing window, is closed, illumination apparatuses are provided. For example, the cooking compartment is then illuminated by the illumination apparatus during operation of the cooking appliance, in which food to be cooked is then prepared in the cooking compartment.

In addition, cooking appliances are also known which have two separate cooking compartments. These are implemented in a single cooking appliance. Furthermore, it is known that a cooking appliance can have a cooking compartment divider. This is formed as a portable divider plate that can be reversibly removed from the entire cooking compartment. As a result, a single cooking compartment can be divided into two separate cooking compartments or into two cooking compartment sub-areas of the one contiguous entire cooking compartment.

BRIEF SUMMARY OF THE INVENTION

It is the object of the present invention to create a cooking appliance apparatus in which, in the presence of multiple cooking compartments, improved differentiation of these cooking compartments from one another is possible, in particular by an observing user.

This object is achieved by a cooking appliance apparatus and a method according to the independent claims.

One aspect of the invention relates to a cooking appliance apparatus having a first cooking compartment and having at least one second cooking compartment that is different therefrom. The cooking compartments are each intended for the introduction of foodstuffs, in particular for the preparation of foodstuffs in the cooking compartment. The cooking appliance apparatus also has an illumination apparatus for illuminating the cooking compartments. The cooking appliance apparatus also has an operating apparatus for setting operating conditions of the cooking appliance apparatus.

The cooking appliance apparatus has the one operating apparatus. This one operating apparatus is provided for setting operating conditions both for the first cooking compartment and also, in particular independently therefrom, for the second cooking compartment. Thus, also in the case of the cooking appliance apparatus, this common or single operating apparatus is provided as intended and used as intended for selecting both separate cooking compartments, in particular, and with regard to individual operating conditions for setting these for the respective cooking compartment. Depending on for which of the cooking compartments in a setting situation currently a setting of operating conditions takes place or is to take place, in the case of the cooking appliance apparatus only this cooking compartment is illuminated by the illumination apparatus with a specific identification illumination scenario. This identification illumination scenario can also be referred to as a visual identification illumination scenario. This allows a user to easily identify which of the two cooking compartments is currently selected and used, or is to be selected and to be used, for a setting of operating conditions. Thus, with the aid of simple visual signaling, a user can be shown the particular cooking compartment of a plurality of cooking compartments of a cooking appliance apparatus which is currently to be selected or has been selected with respect to conditions that are to be further set therein and/or conditions to be set therein are to be set or are being set. These are examples of settings of operating conditions, to which therefore, for example, the selection can be just as appropriate as the setting of conditions therein. By setting conditions, it is also meant conditions concerning a specific temperature and/or a specific humidity and/or a specific microwave radiation in the cooking compartment. This means therefore also that functional units of the cooking appliance are to be operated so that these conditions are reached, in other words the physical parameters with the appropriate values occur.

This also very advantageously avoids a user not knowing during a selection procedure and/or a setting procedure of operating conditions which of the cooking compartments they are about to select or have selected and/or for which cooking compartment they are setting operating conditions. Incorrect settings or uncertainty on the part of the user during operation can thus be avoided. This can also enable a very safe operation of the cooking appliance apparatus. This is because it is also easier to avoid, for example, selecting a cooking compartment and setting operating conditions for this cooking compartment, which does not contain any food to be cooked, while on the other hand the other cooking compartment, in which food to be cooked is placed for preparation, is incorrectly not selected and no corresponding operating conditions for preparing the food to be cooked are set for it.

In one exemplary embodiment, the identification illumination scenario is automatically generated immediately after identification of a setting or of a setting intention of operating conditions of the cooking compartment. For example, this automatic and immediate generation of the identification illumination scenario can take place here under the control of a control unit of the cooking appliance apparatus. A setting in this case is already the start of the setting procedure or the immediate start of such a setting procedure. In the context, a setting intention is a time phase that is immediately prior to a start of a setting. Such a setting intention can, for example, be registered by sensors. In particular, insofar as if a user approaches a corresponding cooking compartment, for example, with an object such as, in particular, a finger or a hand. Such an approach is then also identified in the context as a setting intention. Thus, a setting intention can also be identified in the case of such a scenario, and the corresponding cooking compartment is then already illuminated with the identification illumination scenario before the actual setting of conditions. The same can also be provided if an approach to the operating apparatus takes place. In particular, if the two cooking compartments are displayed on a display on the operating apparatus, in particular symbolically, and one of these two cooking compartments is selected by touch or by approach by a user, this scenario can also already be identified as a setting intention. Even then, the identification illumination scenario for the corresponding cooking compartment can already be automatically generated immediately thereafter and then activated. In particular, the identification illumination scenario has, for example, a specific identification brightness and/or a specific identification light color of the generated light of the illumination apparatus.

In particular, the identification illumination scenario is activated as long as a setting procedure of operating conditions takes place for the cooking compartment that is intended for setting.

In one exemplary embodiment, the identification illumination scenario is different from a normal illumination scenario of the illumination apparatus. At least one cooking compartment is illuminated with the normal illumination scenario at least temporarily if there is no setting procedure of operating conditions for the cooking compartment. In addition or instead thereof, the identification illumination scenario is different from a normal illumination scenario that can be generated by the illumination apparatus with which the other cooking compartment of the cooking appliance apparatus is illuminated at the same time as the cooking compartment is illuminated with the identification illumination scenario. Thus, it can also be provided that a cooking compartment that is currently selected or has been selected and for which specific operating conditions are set or are to be set is illuminated with the identification illumination scenario, and the second cooking compartment is illuminated in the context only with the normal illumination scenario. Thus, each cooking compartment is then illuminated only with a respective specifically provided illumination scenario.

In one exemplary embodiment, the operating apparatus is arranged in a fixed manner on a cooking appliance of the cooking appliance apparatus. This is particularly advantageous if the cooking appliance apparatus has only the cooking appliance and both cooking compartments are contained in this single cooking appliance. Such a cooking appliance then has a common housing in which both cooking compartments are formed.

In another exemplary embodiment, the operating apparatus can be a portable operating apparatus. It can then be reversibly removed from or reattached to the cooking appliance, for example. In another exemplary embodiment, it is also possible that the operating apparatus is completely separate from the cooking appliance in this respect. For example, the portable operating apparatus can be a communication terminal. For example, it can be a mobile communication terminal, such as a smartphone or a tablet. In particular, wireless communication is formed between the operating apparatus and a control unit of the cooking appliance apparatus, wherein the control apparatus or the control unit is provided to control the illumination apparatus.

In one exemplary embodiment, the cooking compartments are arranged permanently separated from each other in a common housing of a cooking appliance of the cooking appliance apparatus. Such fundamentally mutually separated cooking compartments can be provided in specific exemplary embodiments of an oven.

In a further exemplary embodiment, it can be provided that the two cooking compartments are formed as cooking compartment sub-areas of a contiguous cooking compartment that is formed in a cooking appliance. In such an exemplary embodiment, the cooking appliance can have a portable cooking compartment divider. This is provided in particular so as to be reversibly insertable into the cooking compartment and removable therefrom. The cooking compartment divider is then inserted into this cooking compartment in order to separate the contiguous entire cooking compartment into two cooking compartments or two cooking compartment sub-areas. Each of the two cooking compartments then has a corresponding volume in order to be able to accommodate foodstuffs, in particular food to be cooked, for cooking.

In one exemplary embodiment, a cooking compartment divider can be formed as a continuous dividing plate. This can be free of holes or interruptions, so that it forms a continuous closed top wall for the lower cooking compartment and a bottom wall for the upper cooking compartment. In particular, the cooking compartments are formed one above the other as viewed in the height direction of the cooking appliance apparatus, in particular of the cooking appliance.

In another exemplary embodiment, the cooking appliance apparatus can have a first cooking appliance and a second cooking appliance that is separate therefrom. Considering each of the cooking appliances individually, each one is defined by a separate housing and its dimensions are predetermined. Considering the cooking appliances individually, the cooking appliances are respectively closed off or delimited to the outside by this housing or outer housing. Each of these cooking appliances has at least one cooking compartment. In this way, it is also possible even in the case of such an exemplary embodiment that, depending on which cooking appliance is selected by the common, single operating apparatus, which is provided for both cooking appliances, and operating conditions are set in the cooking compartment, this cooking compartment is visually signaled by the identification illumination scenario.

In one exemplary embodiment, the operating apparatus has a display unit or display. It can be provided that at least the cooking compartments, in particular the entire cooking appliance apparatus, are shown on the display, in particular at least symbolically. The display can also be a touch-sensitive display.

In one exemplary embodiment, a user's setting intention for setting operating conditions can be identified depending on a touch-sensitive display being approached and/or touched by a selection object, for example a finger, in particular the cooking compartment that is displayed thereon.

A further aspect of the invention relates to a method for operating a cooking appliance apparatus. The cooking appliance apparatus can be configured according to the above mentioned aspect or an advantageous exemplary embodiment thereof. The operating apparatus renders it possible for operating conditions to be set both for the or in the first cooking compartment and also, in particular independently thereof, for the or in the second cooking compartment. Depending on for which of the cooking compartments a setting of operating conditions is currently taking place or is to take place with the operating apparatus, only this cooking compartment is illuminated by the illumination apparatus with a specific identification illumination scenario. The advantages that can be achieved in this way have already been explained above.

Advantageous embodiments of the cooking appliance apparatus according to the invention are to be regarded as advantageous exemplary embodiments of the method. In the context, the respective components of the cooking appliance apparatus enable the respective method steps to be carried out alone or in at least partial operative connection.

The operating apparatus can be used to set operating conditions. In the context, operating conditions can be specific preparation programs and/or specific settings of heating elements of the cooking appliance apparatus, with which a corresponding heat can be generated in the cooking compartment. It is then also possible in the context to select and set automatic programs, to select a temperature and/or to select a heating mode as well as to set a timer of the cooking appliance apparatus.

However, in addition to the examples mentioned, the cooking appliance apparatus can also have a portable, central control unit. This is then provided for controlling components for both cooking compartments. In particular, such a central control unit can also be provided if the cooking appliance apparatus has two separate cooking appliances.

In addition to the different levels of brightness and/or light colors already mentioned, an identification illumination scenario can also generate different light dynamics. One of these can be, for example, a flashing or a dimming between an upper and a lower brightness value. Both brightness values are then not the brightness value zero, but are different from it. Thus, practically also a continuous and very soft, in particular also wave-like changing of the identification brightness can take place.

A further aspect of the invention relates generally to a method for operating a household appliance. The household appliance has at least one storage compartment for storing items to be stored. The storage compartment is thus intended to receive such items to be stored. An intention to use the storage compartment is registered by a registration unit of the household appliance. Depending on the identification of the intention of use, a signaling apparatus of the household appliance is activated. In particular, this is brought about by a control unit of the household appliance. This is brought about in such a way that the storage compartment that is intended for use is signaled by a specific identification signaling scenario. Using the method, it is now possible that an intention of a user to use a storage compartment can be automatically registered by a registration unit. Such an intention to use the storage compartment is determined, in particular by an evaluation unit that can be a component of a control unit, depending on the evaluation of the information that is registered by the registration unit. A specific identification signaling scenario is then automatically activated. This means that consequently a signaling scenario is set which is only specifically activated if such an intention of use has been identified. This also renders it possible that, if such an intention of use is detected by the system and is thus in particular suspected or if such an intention of use is very likely to exist as a result of evaluation, a specific identification of the storage compartment is performed. The identification signaling scenario distinguishes the storage compartment from the rest of the storage space. Thus, in one exemplary embodiment only this storage compartment is specifically signaled by the identification signaling scenario. This means that it is specifically highlighted and made identifiable. In particular, this can take place visually and/or acoustically and/or haptically.

This means that in particular at the start of use a user can find a very specific, for example visual, scenario with which the storage compartment is illuminated. Thus, the storage compartment is identified in comparison to the remaining environment of the household appliance, in particular the remaining environment of a storage space in which the storage compartment is arranged. Both the identification and also the use of the storage compartment are then further improved. In particular, the identification signaling scenario is one such scenario that simplifies use.

In particular, this takes place with regard to an extensive illumination and/or acoustic identification and/or in haptic identification, so that in particular then also the interior of the storage compartment can be identified extensively and easily. In particular, this identification signaling scenario is generated in such a way that only or essentially only the storage compartment is signaled with it. In particular, such signaling is also takes place with respect to the local position of the storage compartment. Other, possibly existing further storage compartments are then not illuminated with this identification signaling scenario. A particularly advantageous identification and highlighting of this storage compartment that is intended for use is thus achieved.

In particular, this identification signaling scenario is different from a possible other illumination scenario that can be set by the signaling apparatus. Thus, not only one, but multiple signaling scenarios are possible, so that the difference of the signaling scenario with respect to another signaling scenario is also clearly recognized. The difference can be recognized, for example, with regard to the brightness and/or the light color in the case of an identification illumination scenario. Thus, even if another storage compartment and/or the rest of the storage space are also illuminated, a visual difference of the storage compartment that is intended for use can still be achieved by this specific identification illumination scenario which is different therefrom.

An intention of use is seen in particular as an action of a user for which the use of the storage compartment is imminent or has just begun. In particular, an intention of use is a setting request for setting operating conditions for one of the storage compartments. In particular, a storage compartment can be a cooking compartment of the cooking appliance apparatus. The cooking appliance apparatus can be a household appliance. It can be a system having at least one household appliance, in particular a cooking appliance.

In one exemplary embodiment, a user's hand that is approaching the storage compartment and is not yet touching the storage compartment is registered or identified as a usage request. This means that scenarios can also be interpreted as a usage request in which, for example, the user's hand is not yet touching the storage compartment, but is directly in front of it, or in which a targeted approach to the storage compartment is made. Thus, it is also achieved that, if necessary, the identification signaling scenario is already activated if the user has not yet touched the storage compartment or is just about to touch it. Thus, the identification signaling scenario is already activated when the actual use begins. For the entire period of use, this identification signaling scenario in particular can then be activated. This also has advantages of the visual position and/or size of the storage compartment and/or the specific signaling of the interior of the storage compartment that are displayed at the latest with the start of use. If necessary, this also preferably visually signals the loading of items to be stored and/or the removal of items to be stored and/or the identification of which items to be stored are contained in the storage compartment and/or which items to be stored can be placed in the storage compartment. This can also take place, for example, by a specific brightness of the generated light and/or by a specific light color of the light of an illumination apparatus of the household appliance. It is possible not only in the context that light of a light color is generated in an identification illumination scenario. However, it is also possible to provide that different areas of the storage compartment can be illuminated simultaneously with different light colors. This can also be used to emphasize the individual visual signaling of specifications of the storage compartment by the identification illumination scenario. For example, specific subzones of the storage compartment can then be signaled by different light colors both in their position and/or in their size. Again, it is possible in particular for specific items to be stored which are signaled with a specific light color to then be displayed and symbolized, and thus it can be easier for a user to identify which items to be stored can be stored advantageously in which subzone of the storage compartment, if any. This is also possible by means of acoustic and/or haptic signaling.

In one exemplary embodiment, a usage request is, for example, the storage compartment being touched by a hand of a user. This defines the direct contact of the user with the storage compartment as such a usage request. Again, an identification signaling scenario can then be activated very quickly and without delay already upon the start of use. Thus, for example, the storage compartment can have at least one tray or drawer that can be pulled out or pushed in in the depth direction of the cooking appliance. Thus, the identification signaling scenario can already be activated as soon as said tray or drawer is touched and thus before the start or simultaneously with the start of the tray being pulled out. It is then already active when this tray is or will be pulled out at least slightly, so that the advantageous signaling with the identification signaling scenario then also takes place in this respect. Such a tray can, for example, be a warming drawer of a cooking appliance apparatus.

In one exemplary embodiment, the identification signaling scenario is generated automatically and immediately after the identification of the intention of use. This means that the specific signaling is virtually already set when the actual use of the storage compartment is essentially still completely imminent.

In one exemplary embodiment, an identification illumination scenario is generated as an identification signaling scenario with a specific identification brightness and/or a specific identification light color of the generated light of an illumination apparatus as a signaling apparatus, in particular of the household appliance. This individuality allows the storage compartment to be visually distinguished in a particularly advantageous manner from the rest of the storage space, in particular from any further storage compartments of the household appliance that can be present. In particular, the identification brightness is different from a base brightness that is possible with the illumination apparatus. A base brightness is a brightness that is not zero. It can be activated, for example, if normal operation of the home appliance takes place and/or if a storage compartment is not currently intended for use, for example. The storage compartment can then be illuminated in such a scenario, but is not currently intended for use or is not selected for use. The same can also be provided for the light color.

In an exemplary embodiment, the identification signaling scenario remains activated until, for example, a setting of operating conditions in the storage compartment is completed. In one exemplary embodiment, these actions regarding at least this setting can be registered by at least one registration unit, in particular of the household appliance.

In an exemplary embodiment, after completion of such an action, in particular a setting of operating conditions, a normal signaling scenario is set or the signaling apparatus is deactivated. This means that then automatically a switch takes place from the identification signaling scenario to this normal signaling scenario that is different therefrom or the signaling is completely deactivated.

As a result, the entire setting duration can also be automatically accompanied by the identification signaling scenario in a signaled manner. In particular, this identification signaling scenario is then only activated during the duration of the setting action.

In one exemplary embodiment, at least the storage compartment, in particular the entire household appliance, is automatically shown symbolically on a display when a usage request is identified. This display can be arranged on the household appliance itself. However, the display can also be arranged externally to the household appliance, for example on a mobile communication terminal. For example, the communication terminal can be a smartphone or a tablet or the like. Preferably, this household appliance is shown on the display with the identification illumination scenario correspondingly displayed symbolically in terms of brightness and/or light color as an identification signaling scenario. Thus, a visual display is also generated on the display which represents the storage compartment that is intended for use and which also represents the identification illumination scenario which is then activated. In particular, the representation of the household appliance on the display is such that it is shown, for example, in frontal view and with the door open. Thus, the interior or storage space of the household appliance can also be shown on the display at least in areas, in particular completely. Thus, if multiple storage compartments are present and are shown on the display, it is advantageous to visually highlight the storage compartment that is intended for use. A user can thus also easily and comprehensibly understand on the display which storage compartment is intended for use. This means that, with regard to use, in particular a removal of items to be stored from the storage compartment and/or an insertion of items to be stored into the storage compartment and/or a setting of operating conditions of the storage compartment are provided. These are examples of possible usage actions with respect to a usage request.

Such a representation on the display, in particular of the interior having the storage compartments, renders it possible to then also easily identify on the display the size and/or the position of the storage compartment that is intended for use in relation to the other storage compartments. The symbolic representation in this respect on the display is therefore also a further aid for a user for intuitive identification of the desired storage compartment.

In one exemplary embodiment, the visually represented storage compartment is activated on the display and thereby provides a selection option on the display for further setting of operating conditions in the storage compartment. In particular, this means that the relevant represented storage compartment can then be selected, for example, by touching the display. In the context, the display can also have a touch-sensitive surface. This also allows a user to very easily set the operating conditions via the display on the operating apparatus that has the display. For example, in the context, a setting of operating conditions can be a specific temperature in the storage compartment and/or a specific humidity in the storage compartment. Other parameters can then also be set accordingly. In particular, this also makes it possible for the identification illumination scenario to be configured on a user-specific basis.

In one exemplary embodiment, when a request to use a storage compartment is identified, an operating menu level of an operating menu having multiple operating menu levels is displayed at least automatically on a display. This operating menu level is displayed, in which a user can set operating conditions for the storage compartment. In this way, it is achieved in a particularly advantageous manner that automatically with the identification of the usage request, the particular operating menu level which enables an individual setting of operating conditions for the storage compartment is also immediately and automatically shown on the display. Consequently, the setting of the storage compartment is also facilitated for the user in an intelligent manner. The preferred operating menu level for the storage compartment is displayed to the user almost immediately and automatically, and the user does not have to work his way through the various operating menu levels of the operating menu. It is then no longer necessary in this case for the user to find a correct or suitable operating menu level for the storage compartment that is intended for use. In particular, there is an automatic change from a basic operating menu level to a storage compartment operating menu level in which a user can directly set operating conditions for the storage compartment. Thus, this is in particular possible if the operating menu has a main menu which is displayed as the basic setting and thus as the basic operating menu level. Particularly in such exemplary embodiments, it is then automatically achieved that with the identification of the usage request an automatic jump takes place from this main menu into the submenu that is allocated to and/or suitable for the storage compartment and this submenu is then immediately shown on the display. This submenu is then in particular the storage compartment operating menu or the storage compartment operating menu level.

A further aspect of the invention relates to an electronic setting system for a household appliance. This setting system has at least one registration unit and at least one evaluation unit. The setting system is adapted to carry out a method according to the above mentioned aspect or an advantageous exemplary embodiment thereof. In particular, this method is carried out with this electronic adjustment system. The evaluation unit can be a component of a control unit of the household appliance. However, it can also be separate from a control unit of the household appliance.

In one exemplary embodiment, the household appliance has a door with which the storage space can be closed. In this exemplary embodiment, it is also possible that a usage request of a storage compartment can be carried out and registered even if the door is closed. For example, this can be the case if the door is transparent at least in some areas. As a result, one or more storage compartments can be identified even when the door is closed. Therefore, in such exemplary embodiments, it is also possible that, for example, a user, in particular a hand or a finger, can approach a storage compartment in a targeted manner when the door is closed and this can be identified. Thus, for example, a storage compartment can be selected for use even when the door is closed. It is then also possible to set the operating conditions of the selected storage compartment when the door is closed.

In another exemplary embodiment, when the door of a household appliance is closed, the household appliance can likewise be displayed on a display of the operating apparatus, at least in some areas. A user can then provide a storage compartment for use on the display. It is also possible in this case for a usage request to be identified accordingly. In particular, by approaching the particular area of the display on which the storage compartment that is intended and desired for use is symbolically displayed. It is also possible in this case for this approach to the sub-zone of the display and/or the touching of the sub-zone of the display in which the storage compartment is displayed to then be registered and, depending on this, the identification illumination scenario can automatically appear symbolically on the display and accordingly illuminate the storage compartment that is displayed there and/or illuminate the actual storage compartment in the storage space of the household appliance with the identification illumination scenario.

The storage compartments in a storage space can be designed in different positions and/or sizes and/or number ratios. It can be provided that after an end of an interaction or a usage procedure, the condition that exists before the recognized usage request is automatically set again. It is also possible that a time-delayed highlighting or signaling takes place. For example, if a user starts a time-based process, for example via the operating apparatus, in particular on the touch-sensitive display, then after the start time has been reached, the corresponding storage compartment is highlighted by an identification signaling scenario, in particular an identification illumination scenario and/or an identification acoustic scenario and/or by an identification haptic scenario.

A household appliance is in particular a cooking appliance apparatus. A storage compartment is in particular a cooking compartment.

The indications "top", "bottom", "front", "rear", "horizontal", "vertical", "depth direction", "width direction", "height direction" etc. indicate the positions and orientations that are given when the appliance is used as intended and arranged as intended.

Further features of the invention are apparent in the claims, the figures and the description of the figures. The features and combinations of features that are mentioned above in the description, as well as the features and combinations of features that are mentioned below in the description of the figures and/or are shown alone in the figures, can be used not only in the combination indicated in each case, but also in other combinations or as standalone, without leaving the scope of the invention. Thus, embodiments of the invention are also to be regarded as encompassed and disclosed by the invention which are not explicitly shown and explained in the figures, but which arise from and can be generated by separate feature combinations of the embodiments mentioned. Thus, also embodiments and combinations of features which thus do not have all features of an originally formulated independent claim are to be regarded as disclosed.

Exemplary embodiments of the invention are explained in more detail below with reference to schematic drawings.

DETAILED DESCRIPTION OF EXEMPLARY EMBODIMENTS OF THE PRESENT INVENTION

Figure 1:
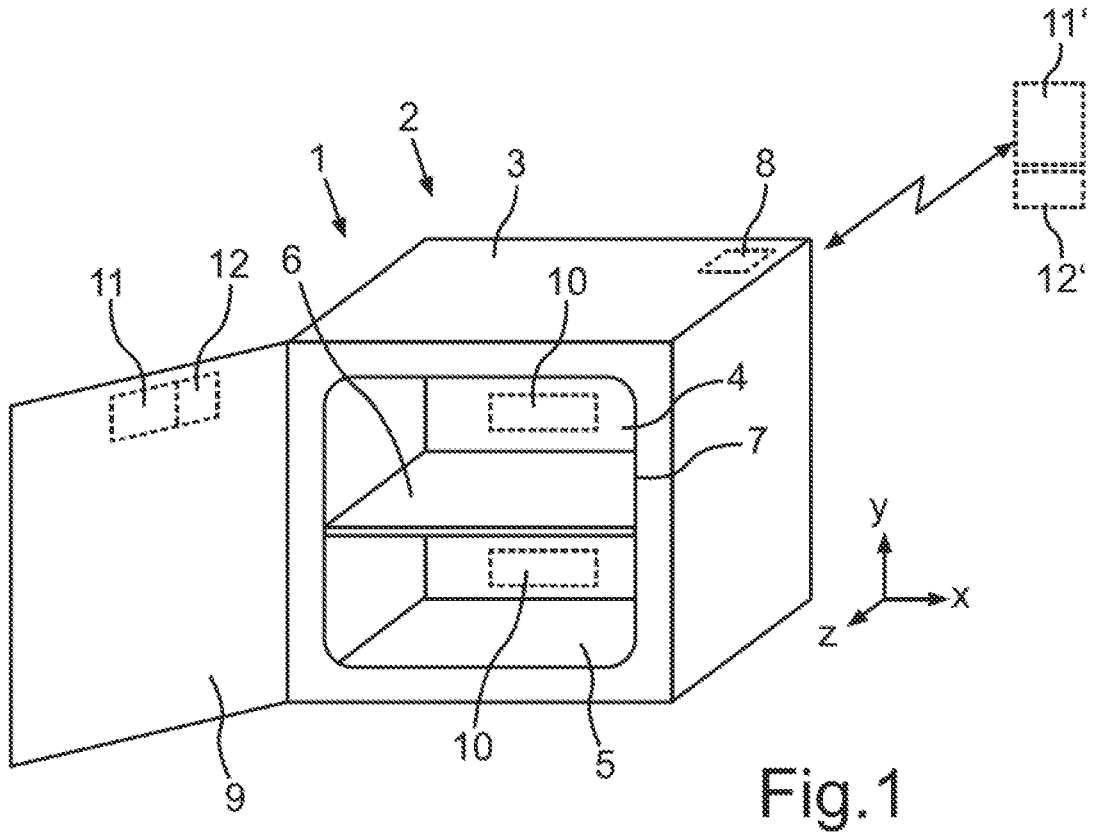
FIG. 1 shows a perspective view of an exemplary embodiment of a household appliance apparatus according to the invention.

In the figures, identical or functionally identical elements are given the same reference characters.

FIG. 1 shows a schematic representation of an exemplary embodiment of a household appliance, in particular a cooking appliance apparatus 1. In the case of this exemplary embodiment, the cooking appliance apparatus 1 has a single cooking appliance 2. This cooking appliance 2 has a housing 3. This housing 3 can also be referred to as an outer housing. Furthermore, the cooking appliance 2 has a first cooking compartment 4. Furthermore, this cooking appliance 2 has a second cooking compartment 5 that is different from the first cooking compartment 4. The two cooking compartments 4 and 5 are separated from each other except for their front loading openings. In the height direction (y-direction) of the cooking appliance 2, the cooking compartments 4 and 5 are arranged one above the other. They are separated by a divider wall 6. The divider wall 6 can be arranged in a non-detachable manner in the cooking appliance 2. In the case of such an exemplary embodiment, the cooking compartments 4 and 5 are then permanently separated from each other. They cannot then be connected to form an entire common larger cooking compartment. In another exemplary embodiment, the divider wall 6 can be a reversibly removable and reinsertable wall. In the context, it can be a plate-shaped cooking compartment divider. In such an exemplary embodiment, this divider wall 6 can then also be removed so that the cooking compartments 4 and 5 then form a common contiguous and uninterrupted entire cooking compartment.

The cooking compartments 4 and 5 can be delimited by a muffle 7 of the cooking appliance 2. The muffle 7 can be a common muffle for both cooking compartments 4 and 5. If the divider wall 6 is arranged in a non-detachable manner, two separate muffles can be provided which delimit the cooking compartment 4 on the one hand and the cooking compartment 5 on the other hand with their walls. The muffle 7 is a separate component from the housing 3. It is accommodated in the housing 2.

The cooking appliance 2 also has a control unit 8. In addition, the cooking appliance 1 has a door 9. This is movably arranged on the housing 3. It is provided for closing the cooking compartment 4 and the cooking compartment 5 at the front. Furthermore, the cooking appliance apparatus 1 also has an illumination apparatus 10. The illumination apparatus 10 is designed for illuminating the cooking compartments 4 and 5. Furthermore, the cooking appliance apparatus 1 has an operating apparatus 11. In one exemplary embodiment, this can be arranged on the single cooking appliance 2 itself. It can be arranged there in a non-detachable manner. However, in another exemplary embodiment, it can be arranged in a detachable manner on the cooking appliance 2, for example on the door 9. In another exemplary embodiment, the cooking appliance 2 can have a front control panel that is arranged in a fixed manner on the housing 3 and is a separate component from the door 9. The operating apparatus 11 can then be arranged on this operating panel.

The operating apparatus 11 can additionally also have a display unit, in particular a display 12. In one exemplary embodiment, this display 12 can be designed at least in some areas as a touch-sensitive user interface. In another exemplary embodiment, the cooking appliance apparatus 1 can have an operating apparatus 11' which is, in particular permanently, separate from the cooking appliance 2. The cooking appliance apparatus 1 is then a system comprising the at least one cooking appliance 2 and the operating apparatus 11' that is separate therefrom. In such an exemplary embodiment, the operating apparatus 11' can also be a communication terminal, such as for example a smartphone or a tablet. The operating apparatus 11' is then preferably designed only for wireless communication with the cooking appliance 2. The cooking appliance apparatus 1 can generally be a component of a communication network. In particular, this can be a communication network in which multiple household appliances are integrated. The operating apparatus 11' can also have a display 12'.

In particular, it is provided that the only one operating apparatus 11 for setting operating conditions is provided both for the first cooking compartment 4 and also, in particular independently thereof, for the second cooking compartment 5 or is used as intended. The same can be provided in another exemplary embodiment, if only the single operating apparatus 11' is then present. The same operating elements and/or or control panels of the operating apparatus 11, 11' are then provided for setting operating conditions in the first cooking compartment 4 and in the second cooking compartment 5.

Depending on for which of the cooking compartments 4 or 5, in particular currently, a setting of operating conditions is taking place or is to take place with the operating apparatus 11 or 11', only this cooking compartment 4 or 5 is illuminated by the illumination apparatus 10 with a specific identification illumination scenario. The other cooking compartment 4 or 5 that is not selected and not intended for setting operating conditions in the cooking compartment is then not illuminated or is illuminated with a normal illumination scenario of the illumination apparatus 10 that is different from the identification illumination scenario.

This ensures that in the case of a cooking appliance apparatus 1 having at least two separate cooking compartments 4 and 5, in particular during a procedure for setting operating conditions in this cooking compartment or for this cooking compartment, only this then specific cooking compartment is illuminated with a specific identification illumination scenario. This selected cooking compartment 4 or 5 is thus specifically signaled visually.

In one exemplary embodiment, it is provided that the identification illumination scenario is automatically generated, in particular controlled by the control unit 8, immediately after the identification of a setting or of a setting intention of operating conditions in the cooking compartment or for the cooking compartment 4 or 5, respectively, and is activated. In one exemplary embodiment, the identification illumination scenario has a specific identification brightness and/or a specific identification light color of the generated light of the illumination apparatus 10 and/or a specific light emission dynamics of the generated light of the illumination apparatus 10.

In particular, the identification illumination scenario remains activated as long as a setting procedure of operating conditions for the cooking compartment 4 or 5 that is intended for setting takes place.

During the time period in which the cooking compartment 4 or 5 that is selected and is intended for the setting of operating conditions is illuminated with the identification illumination scenario, the other cooking compartment 4 or 5 is not illuminated or is illuminated with a normal illumination scenario of the illumination apparatus 10 that is different therefrom.

Figure 2:
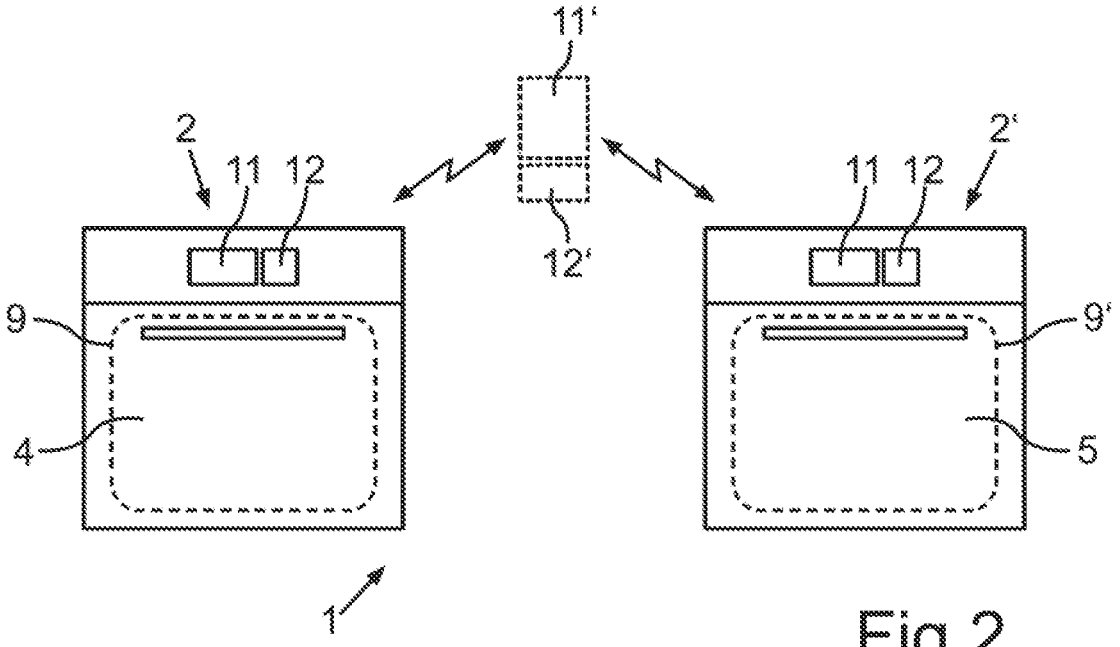
FIG. 2 shows a perspective view of a further exemplary embodiment of a household appliance apparatus according to the invention.

FIG. 2 shows a further exemplary embodiment of a cooking appliance apparatus 1. Here, the cooking appliance apparatus 1 has a first cooking appliance 2 and a further cooking appliance 2' that is separate therefrom. The first cooking appliance 2 has at least one cooking compartment 4. The second cooking appliance 2' has at least one separate and dedicated cooking compartment 5. In FIG. 2, the cooking appliances 2 and 2' are shown from the front. The respective doors 9 and 9' are shown closed here. Exemplary operating apparatuses 11 of the cooking appliances 2 and 2' are shown here. It can be provided in one exemplary embodiment that the cooking appliance 2 has one operating apparatus 11. This single operating apparatus 11 can be provided in one exemplary embodiment for setting operating conditions for both cooking appliances 2 and 2', in particular in their cooking compartments 4 and 5. It is also possible in another exemplary embodiment that only the cooking appliance 2' has an operating apparatus 11 with which both cooking appliances 2, 2' can be set in their operating conditions, in particular cooking compartments 4, 5 are also selected here and/or specific conditions are set therein. This can then also be used to set operating conditions of the other cooking appliance 2, in particular its cooking compartment 4. In a further exemplary embodiment, a separate single common operating apparatus 11' can also be provided in the case of the cooking appliance apparatus 1 according to FIG. 2. This can then also be used to set operating conditions for both cooking appliances 2 and 2', in particular their cooking compartments 4 and 5. Again, in this exemplary embodiment, the operating apparatus 11' can communicate in a wireless manner with the cooking appliances 2 and 2'. The operating apparatuses 11, 11' can also have displays 12, 12' in this case.

The invention claimed is:

1. A cooking appliance apparatus, comprising:

a first cooking compartment;

a second cooking compartment that is different from the first cooking compartment;

an operating apparatus designed to set operating conditions for both the first cooking compartment and the second cooking compartment; and an illumination apparatus designed to illuminate the first and second cooking compartments in such a way that depending on for which one of the first and second cooking compartments the operating apparatus currently sets the operating conditions, only the one of the first and second cooking compartments is illuminated by the illumination apparatus with a specific identification illumination scenario, wherein the identification illumination scenario is different from a normal illumination scenario of the illumination apparatus, with at least one of the first and second cooking compartments being illuminated with the normal illumination scenario at least at times when the operating apparatus does not set operating conditions and/or with the other one of the first and second cooking compartments being illuminated with the normal illumination scenario at a same time as the one of the first and second cooking compartments is illuminated with the identification illumination scenario.

2. The cooking appliance apparatus of claim 1, wherein the identification illumination scenario is automatically generated immediately after identification of a setting or of a setting intention of operating conditions of the one of the first and second cooking compartments.

3. The cooking appliance apparatus of claim 1, wherein the identification illumination scenario has a specific identification brightness and/or a specific identification light color and/or a specific light dynamics generation of the generated light of the illumination apparatus.

4. The cooking appliance apparatus of claim 1, wherein the identification-illumination scenario is activated as long as a setting procedure of operating conditions for the one of the first and second cooking compartments that is intended for setting takes place.

5. The cooking appliance apparatus of claim 1, further comprising a cooking appliance, said operating apparatus being arranged in a fixed manner on the cooking appliance.

6. The cooking appliance apparatus of claim 1, wherein the operating apparatus is a portable operating apparatus.

7. The cooking appliance apparatus of claim 1, further comprising a single cooking appliance in which the first and second cooking compartments are arranged.

8. The cooking appliance apparatus of claim 7, wherein the cooking appliance includes a housing, said first and second cooking compartments being arranged permanently separated from one another in the housing of the cooking appliance.

9. The cooking appliance apparatus of claim 1, further comprising:

a first cooking appliance having one of the first and second cooking compartments; and a second cooking appliance separate from the first cooking appliance and having the other one of the first and second cooking compartments.

10. The cooking appliance apparatus of claim 1, wherein the operating apparatus includes a display for displaying the first and second cooking compartments, in particular the cooking appliance in its entirety.

11. The cooking appliance apparatus of claim 10, wherein the display is designed to display the first and second cooking compartments symbolically.

12. The cooking appliance apparatus of claim 1, wherein the operating apparatus includes a touch-sensitive display designed to identify a setting request of a user for setting the operating conditions when being approached or touched.

13. A cooking appliance apparatus, comprising:

a first cooking compartment;

a second cooking compartment that is different from the first cooking compartment;

an operating apparatus designed to set operating conditions for both the first cooking compartment and the second cooking compartment;

an illumination apparatus designed to illuminate the first and second cooking compartments in such a way that depending on for which one of the first and second cooking compartments the operating apparatus currently sets the operating conditions, only the one of the first and second cooking compartments is illuminated by the illumination apparatus with a specific identification illumination scenario; and a single cooking appliance in which the first and second cooking compartments are arranged, wherein the first and second cooking compartments are formed as cooking compartment sub-areas of a contiguous cooking compartment, and further comprising a cooking compartment divider designed for reversible insertion into and removal from the contiguous cooking compartment, and to separate the contiguous cooking compartment into the first and second cooking compartments when inserted into the contiguous cooking compartment.

14. The cooking appliance apparatus of claim 13, wherein the cooking compartment divider is formed as a continuous divider plate.

15. A method for operating a cooking appliance apparatus comprising different first and second cooking compartments; said method comprising:

setting with an operating apparatus operating conditions for both the first cooking compartment and the second cooking compartment; and illuminating the first and second cooking compartments in such a way that depending on for which one of the first and second cooking compartments the operating apparatus currently sets the operating conditions, only the one of the first and second cooking compartments is illuminated by the illumination apparatus with a specific identification illumination scenario, wherein the identification illumination scenario is different from a normal illumination scenario of the illumination apparatus, and further comprising illuminating at least one of the first and second cooking compartments being illuminated with the normal illumination scenario at least at times when the operating apparatus does not set operating conditions and/or illuminating the other one of the first and second cooking compartments with the normal illumination scenario at a same time as the one of the first and second cooking compartments is illuminated with the identification illumination scenario.

16. The method of claim 15, further comprising automatically generating the identification illumination scenario immediately after identification of a setting or of a setting intention of operating conditions of the one of the first and second cooking compartments.

17. The method of claim 15, wherein the identification-illumination scenario is activated as long as a setting procedure of operating conditions for the one of the first and second cooking compartments that is intended for setting takes place.

18. The method of claim 15, further comprising displaying the first and second cooking compartments, in particular the cooking appliance in its entirety.

19. The method of claim 15, further comprising identifying and displaying a setting request of a user for setting the operating conditions when a touch-sensitive display is approached or touched.

* * * * *